US011179647B2

(12) United States Patent
Khotiun et al.

(10) Patent No.: US 11,179,647 B2
(45) Date of Patent: Nov. 23, 2021

(54) TRINKET TRANSFORMABLE INTO A WHIRLIGIG FOR ENRICHMENT

(71) Applicants: Andrii Khotiun, Tarzana, CA (US); Yulia Skornyakova, Tarzana, CA (US)

(72) Inventors: Andrii Khotiun, Tarzana, CA (US); Yulia Skornyakova, Tarzana, CA (US)

( * ) Notice: Subject to any disclaimer, the term of this patent is extended or adjusted under 35 U.S.C. 154(b) by 0 days.

(21) Appl. No.: 16/860,340

(22) Filed: Apr. 28, 2020

(65) Prior Publication Data

US 2020/0406155 A1 Dec. 31, 2020

Related U.S. Application Data

(60) Provisional application No. 62/866,839, filed on Jun. 26, 2019.

(51) Int. Cl.
*A63H 1/02* (2006.01)
*A44C 3/00* (2006.01)

(52) U.S. Cl.
CPC ..... *A63H 1/02* (2013.01)

(58) Field of Classification Search
CPC .. A44C 3/00; A44C 15/00; A63H 1/00; A63H 1/02; A63H 33/00
USPC ..... 446/240, 243, 246, 250; 63/1.11
See application file for complete search history.

(56) References Cited

U.S. PATENT DOCUMENTS 629,055 A * 7/1899 Wallace
1,059,886 A * 4/1913 Loomis ..... A63H 1/32 446/245
2,573,916 A 11/1951 Loveday
3,968,661 A 7/1976 Williams
5,147,236 A * 9/1992 Hartman ..... A63H 1/32 446/253
5,979,184 A * 11/1999 Razza ..... A44C 15/0045 446/250
2006/0166596 A1 7/2006 Dufort
2006/0233647 A1 * 10/2006 Saunders ..... F01D 5/34 416/223 A
2018/0352919 A1 12/2018 Cucchiara et al.
2019/0160388 A1 5/2019 Hacsi

FOREIGN PATENT DOCUMENTS

DE 29515347 U1 11/1995
WO 2019106653 A1 6/2019

* cited by examiner

*Primary Examiner* — Kien T Nguyen
(74) *Attorney, Agent, or Firm* — Lamon Patent Services; Cynthia S. Lamon

(57) ABSTRACT

1. A whirligig assembly includes a body having equally distributed weight about the center-point of the body, a central opening provided through the body, at least one stem opening provided through the side of the body extending orthogonally through the central opening and breaking out at opposing sides of the body, and a stem having a first end formed as a whirligig point and a second end formed as an attachment end, the first end including a stop flange located just above the base of the whirligig point on the stem. The stem may be inserted through one of the at least one stem openings and may be attached to a mechanism to suspend the body vertically on the stem and, wherein the stem may be inserted through the central opening of the body to enable function as a whirligig.

16 Claims, 4 Drawing Sheets

TRINKET TRANSFORMABLE INTO A WHIRLIGIG FOR ENRICHMENT

CROSS-REFERENCE TO RELATED DOCUMENTS

The present invention claims priority to a provisional patent U.S. application 62/886,839 filed on Aug. 14, 2019, entitled Transforming Trinket, disclosure of which is included herein at least by reference.

BACKGROUND OF THE INVENTION

1. Field of the Invention

The present invention is in the field of physical and mental enrichment for medical patients and pertains particularly to methods and apparatus for assembling a whirligig from an adornment.

2. Discussion of the State of the Art

In the art of physical recovery and rehabilitation, there are enrichment tools including mechanical devices that are adapted to help a patient focus and perform physical activities during recovery or rehabilitation periods, some activities devoted to helping the patient improve muscle coordination and mental state of focus or calmness. One problem is that many people recovering or rehabilitating in private settings may not have ready access to these types of tools. In some cases, they have access to enrichment tools but lose them or misplace them and therefore must delay until same is found again.

Therefore, what is clearly needed is an enrichment tool that may be worn by the user and that may be assembled easily into an enrichment tool for improving mental state, muscular dexterity, and coordination.

BRIEF SUMMARY OF THE INVENTION

According to an embodiment of the present invention, a whirligig assembly is provided and includes a symmetric body with the weight of the body distributed equally about the center-point of the body, the body having an perimeter boundary and a height dimension less than the dimension of the perimeter boundary, a central opening provided through the body, the central opening having a symmetric form aligned perpendicularly to the central plane of weight distribution of the body, at least one stem opening provided through the side of the body, the at least one stem opening extending orthogonally through the central opening and breaking out at opposing sides of the body, and an elongated stem having a first end formed as a whirligig point concentric with the longitudinal axis of the stem and a second end formed as an attachment end, the first end including a stop flange concentric with the longitudinal axis of the stem located just above the base of the whirligig point, the diameter of the flange larger than the diameters of the central opening and the at least one stem opening. The stem may be inserted through one of the at least one stem openings leading with the second end of the stem and may be attached to a mechanism to suspend the body vertically on the stem and, wherein the stem may be inserted through the central opening of the body leading with the second end of the stem to enable function as a whirligig.

In one embodiment, the symmetric body is annular. In one embodiment, the central opening is hexagonal. In one embodiment, the symmetric body and the stem are fabricated of metal material. In another embodiment, the symmetrical body is fabricated of polymer with equally distributed weight inserts about the perimeter of the body. In one embodiment, the elongated stem has a hexagonal form extending from the stop flange above the point to a point along the longitudinal axis toward the second end.

In one embodiment, the elongated stem is tapered conically in diameter from the stop flange to the tip of the second end. In one embodiment, the whirligig assembly further includes a radial groove on the elongated stem adjacent to the stop flange on the point side of the flange. In still another embodiment, the whirligig assembly further includes a pattern of material relief cutouts arranged symmetrically about the whirligig body in accordance with equal distribution of body weight, the cutouts providing sound during operation of the assembly as an assembled whirligig.

According to one aspect of the invention, a method for assembling a functional whirligig from a whirligig assembly in a suspended state, the whirligig assembly including a whirligig body with a central opening and at least one stem opening extending through the whirligig body orthogonally through the central opening and breaking out at opposing sides of the whirligig body, and an elongated stem having a whirligig point and a stop flange at a first end, and an attachment feature to a suspension mechanism at the second end including steps, (a) removing the suspended whirligig assembly from suspension mechanism, (b) remove the suspended whirligig body from the stem; and (c) insert the stem through the central opening of the whirligig body aligning the geometric form of the central opening and stem and sliding the body down to the stop flange on the stem.

In one aspect of the method, in step (a), the suspension mechanism is a chain, tether, or a carabiner. In one aspect, in step (c), the geometric form is a hexagon. In one aspect, in step (a), the whirligig body is fabricated of polymer with equally distributed weight inserts about the perimeter of the body.

According to another aspect of the invention, a method for assembling a whirligig assembly in a suspended state from a functional whirligig, the whirligig assembly including a whirligig body with a central opening and at least one stem opening extending through the whirligig body orthogonally through the central opening and breaking out at opposing sides of the whirligig body, and an elongated stem having a whirligig point and a stop flange at a first end, and an attachment feature to a suspension mechanism at the second end including steps, (a) removing the whirligig body from the stem, (b) inserting the stem from the attachment end through one of the at least one stem openings, sliding the body down to the stop flange suspending the body vertically on the stem, and (c) attaching the stem to a suspension mechanism.

In one aspect of the method, in step (c), the suspension mechanism is a chain, tether, or a carabiner. In another aspect, in step (a), the whirligig body is fabricated of polymer with equally distributed weight inserts about the perimeter of the body.

DETAILED DESCRIPTION OF THE INVENTION

In various embodiments described in enabling detail herein, the inventor provides a unique system of enrichment for a person comprising of an assembled apparatus transformable between two states, one state where the apparatus is a wearable ornamental medallion, and another state where it is used as an enrichment tool more particularly, a whirligig.

It is a goal of the present invention to provide an enrichment tool in the form of a whirligig that a user may assemble from a wearable ornamental medallion having two parts and use to focus direction, relieve tension, or improve manual dexterity. It is also a goal of the invention to reduce the possibility of loss of the parts of the apparatus by the user by way of adapting the parts to be assembled and worn in decorative manner or assembled and carried with other important articles like keys on a key ring. It is a further goal of the invention that the user may assemble and dissemble the parts with ease or minimum task load. The present invention is described in enabling detail using the following examples, which may describe more than one relevant embodiment falling within the scope of the invention.

Figure 1:
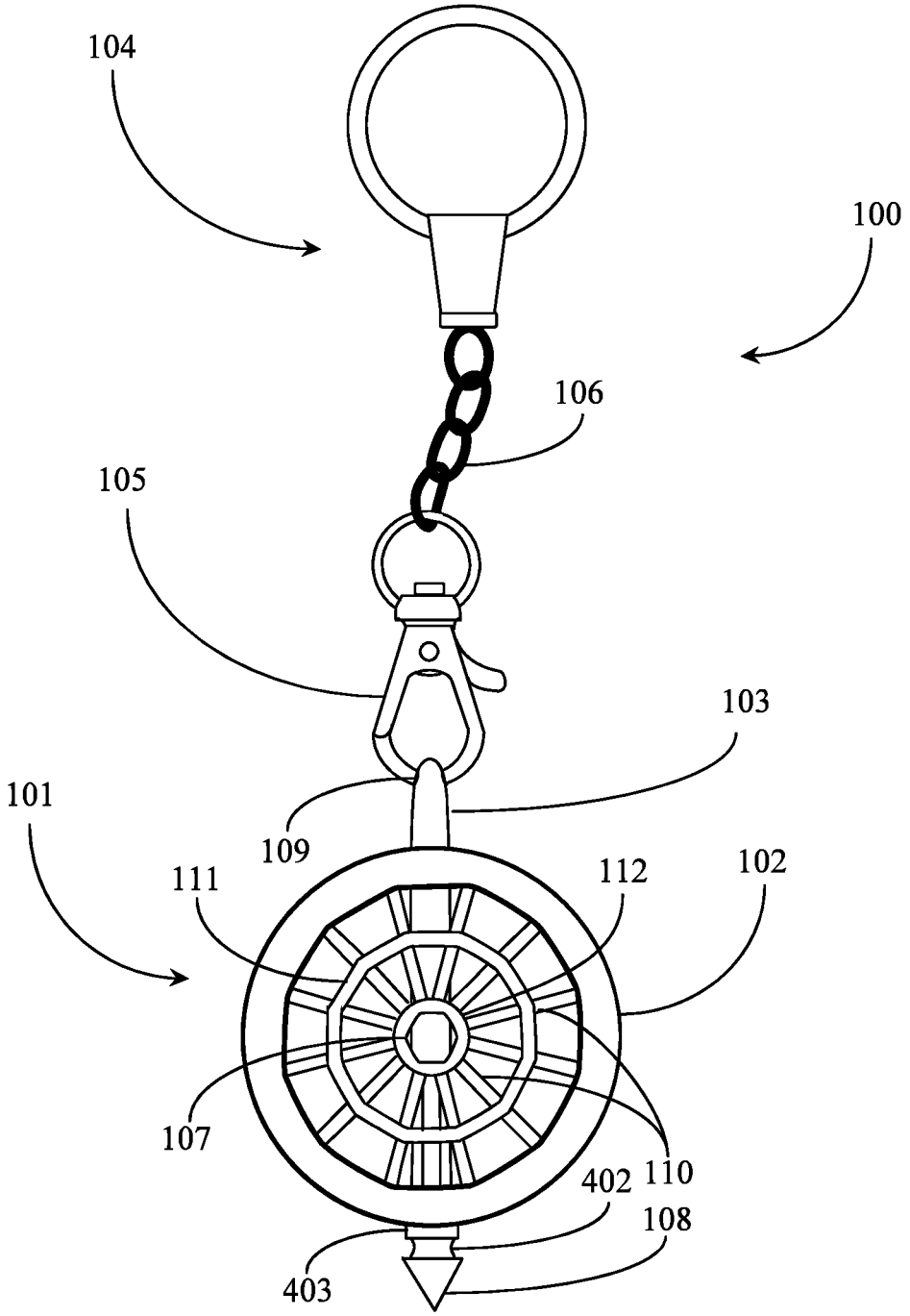
FIG. 1 is an elevation view of a transformable medallion attached to a keyring carabiner combination chain in one embodiment of the invention.

FIG. 1 is an elevation view of a transformable medallion 101 attached to a keyring carabiner combination chain 100 according to an embodiment of the invention. Keyring carabiner chain 100 includes a keyring 104 attached to a carabiner 105 by a short chain 106. A medallion 101 may comprise two connectable parts that include a medallion body 102 and a tapered stem 103. Stem 103 is depicted hanging from carabiner 105 via a through opening 109 placed through stem 103 proximal to the end of the stem.

Medallion body 102 may include at least one opposing pattern of stem openings (not visible in this view) through the side of the body and intersecting at least via alignment the middle portion of the body. The stem openings, referred to later in this specification as openings 300 in description of FIG. 3A, may be sized to accept insertion of tapered stem 103 down to a conical stem point 108 to be hung on carabiner 105. In other embodiments, medallion 101 (body 102 over stem 103) may be worn on a necklace, on a choker, on an arm band, on a belt, or on a purse without departing from the spirit and scope of the invention.

Wearing medallion 101 may function to keep the transformable medallion accessible to a medical patient that may benefit from the device. In this case, medallion body 102 is hung on stem 103 and is stopped from falling by a larger diameter flange 403 provided before stem point 108 and above a groove feature 402 of stem point 108. Therefore, body 102 is placed over stem 103 and is retained at or just above stem point 108. Stop flange 403 also provides a stop for medallion body 102 to rest against when suspended as a medallion 101 and when stem 103 may be used as an axle in a whirligig application.

Medallion body 102 is fabricated as a symmetrical form where the weight of body 102 is evenly distributed out from the center point of the body 102 so that the body 102 may be balanced relative to weight and may be physically spun about the center without wobble. Body 102 may be a metallic body, somewhat heavy, having spokes 110, concentric rings 111 and 112 fixed together to form the body 102. Body 102 includes a center through opening in the form of a hexagonal opening 107 extending through the body. Body 102 has enough weight to function as a top or whirligig body. Hexagonal opening 107 may be of a different geometric form without departing from the spirit and scope of the invention. The hexagonal form is adapted to receive the hexagonal shape of at least a portion of the length of stem 103.

Stem 103 is tapered slightly from just above the stem point 108 to the top of the stem where attachment to carabiner 105 via opening 109 occurs. Stem point portion 108 of stem 103 includes a flange 403 larger in diameter than the stem openings (300) in body 102 through which stem 103 is inserted to hang as a pendent or from a key ring. The top end of stem 103 is inserted through the side openings in the side of body 102 to stage medallion 101 for convenient display as a medallion that can be worn and that may be assembled into a whirligig. A significant length of the lower body portion of stem 103 has a hexagonal form that is just smaller in dimension than hexagonal opening 107 to provide a snug fit.

Medallion body 102 may be a solid metal piece, or two metal pieces mounted together without departing from the spirit and scope of the invention. Body 102 may be a solid metal body or a composite material without departing from the spirit and scope of the invention. Body 102 may be diecast, stamped, or cut from raw material on a metal lathe. Materials used for medallion body 102 and for stem 103 may include brass, copper, steel, composites thereof, or other forms of metal having enough weight to function as a whirligig. In one embodiment, body 102 may be fabricated, including molded from a lighter material like a polymer that has provisions for accepting a symmetrical application of inserted weights. Medallion body 102 may include proprietary or non-proprietary characters, logos, symbols, text, or a combination thereof engraved or stamped or otherwise placed on the outer sides and solid surfaces of the body.

Stem 103 functions as an attachment mechanism for suspending and displaying medallion body 102 in a vertical orientation and functions as a solid spin axle for the whirligig assembly. Materials used for medallion body 102 and for stem 103 may include brass, copper, steel, composites thereof, or other forms of metal having enough weight to promote function as a whirligig.

Figure 2A:
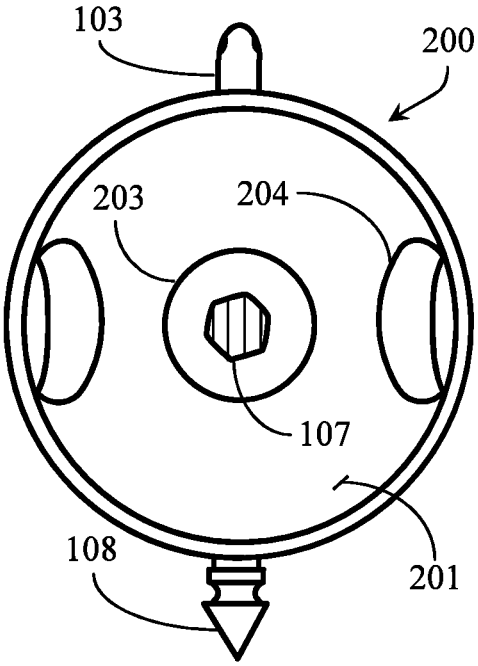
FIG. 2A through FIG. 2D are overhead views of medallions having alternative disc designs according to embodiments of the present invention.

FIG. 2A through FIG. 2D are overhead views of medallions having alternative disc designs according to embodiments of the present invention. Referring to FIG. 2A, a medallion 200 is depicted that has an alternative design than medallion 101 of FIG. 1. Medallion 200 includes a relatively more solid body 201. Body 201 shares attributes with body 102 of FIG. 1 in that it is fabricated as a symmetrical form (annular) where the weight of body 201 is evenly distributed out from the center point of the body 201 so that the body 201 may be balanced relative to weight distribution and spun about the center without wobble.

Body 201 may be a metallic body having enough weight to function as a whirligig body. Materials used for medallion body 201 and for stem 103 may include brass, copper, steel, composites thereof, or other polymer composites and forms of metal having enough weight to function as a whirligig. Body 201 includes the center hexagonal opening 107 extending through the body. Body 201 includes opposing material relief cutouts 204 and a raised annular surface 203, which is concentric with the hexagonal opening 107. Body 201 is positioned over stem 103 through at least one pair of opposing aligned openings analogous to openings 300 (referenced in FIG. 1, depicted in FIG. 3) intersecting center of the body or via a bore provided through the side of the body (if solid) and intersecting the center of the body.

Cutout features 204 may be decorative and part of ascetics of the medallion. In one embodiment, cutout features 204 may reduce weight of body 201. In one embodiment, cutouts may be adapted to produce a sound when the medallion 200 is transformed into a whirligig and spun by a user. Body 201 may be a decorative annular disc. Other geometric shapes that are symmetrical (all sides the same) may also be used as a body form besides an annular shape such as an octagonal or hexagonal medallion, a six-point star, or a square form for example. Medallion body 201 may include proprietary or non-proprietary characters, logos, symbols, text, or a combination thereof engraved or stamped or otherwise placed on the outer sides and solid surfaces of the body.

Figure 2B:
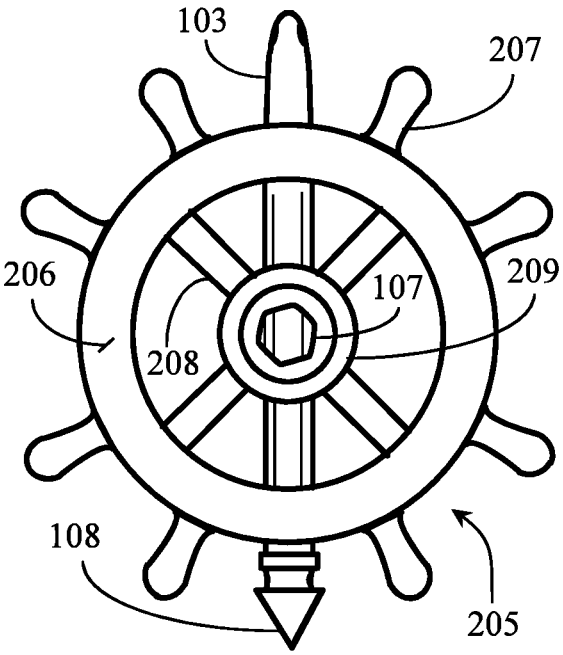

Referring to FIG. 2B, a medallion 205 is provided in the form of a decorative ship's helm (steering wheel). In this case medallion 205 represents a symbol. Medallion 205 includes a body comprising an outer ring 206, and at least an inner ring 209 held concentric by a symmetrically arranged pattern of spokes 208. A plurality of helm handles 207 is provided and disbursed about the circumference of the outer ring 206 in a symmetric pattern with equal weight distribution. The hexagonal through opening 107 for stem 103 occupies center of the body.

Hexagonal opening 107 occupies center of the medallion body and provides a central opening. Stem 103 is inserted from the top of the stem through opening 107 to operate the medallion as a top or whirligig. A hex shape is used in this example to prevent the stem, which is also hex shaped from spinning within the opening independently of the body. Central opening 107 is large enough in inside diameter to accept the outside diameter of stem 103. The stem 103 may be inserted from the smaller rounded end and down past a point on the stem 103 with matching geometry that snugly abuts against and balances the medallion body 201 when it is caused to spin about stem 103 on a hard surface such as on a table top for example.

Figure 2C:
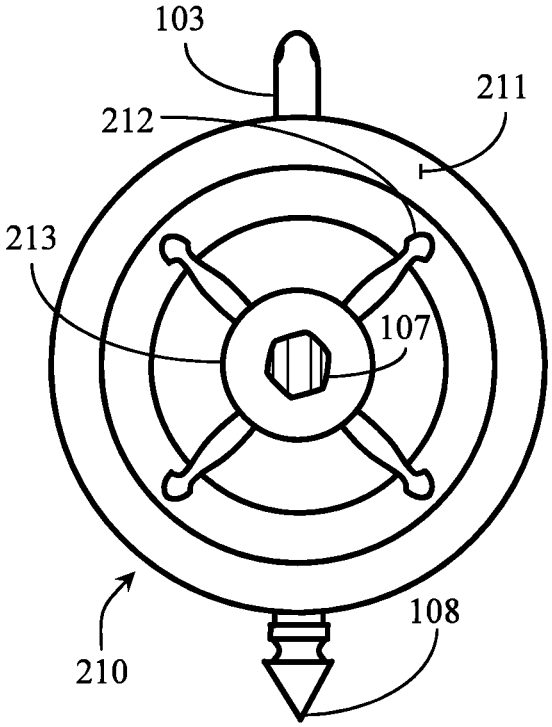

Referring to FIG. 2C, medallion 210 is provided and adapted to be hung on stem 103 in the same manner as medallions 101, 200, and 205 described above. Medallion 210 includes a relatively solid body 211 that may include one or more concentric steps or grooves. An inner ring 213 may be contiguous with body 211 or may be a separate piece fixed at center of the larger body piece. Body 211 is adapted to be hung onto stem 103 in the same manner as all the previously described bodies via at least one opposing pattern of openings provided through the side and intersecting the center of the medallion body.

In this design, ring 213 is faced off (elevated flat surface) at a higher elevation than the surrounding surface. Decorative apertures 212 are provided and arranged symmetrically about ring 213 the apertures 212 extending out from the side wall of ring 213. Apertures 212 may be in elevation above the surrounding surface or may lie on or against the underlying surface. Medallion bodies in general and regardless of decorative forms may be a solid metal piece, or two or more metal pieces mounted or fixed together without departing from the spirit and scope of the invention.

Figure 2D:
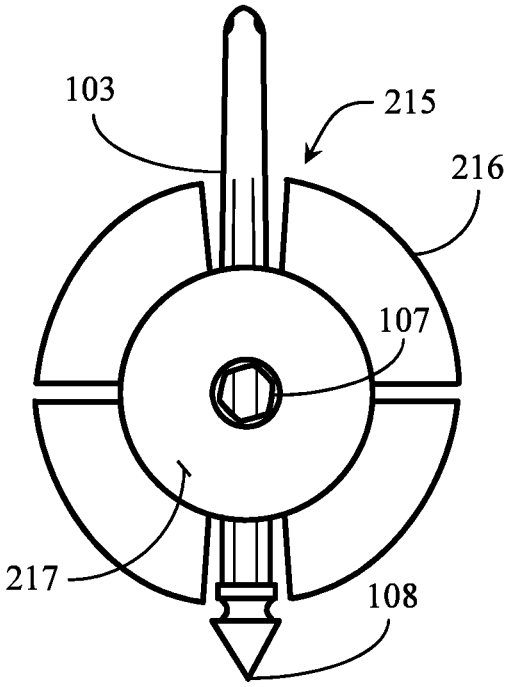

Referring to FIG. 2D, a medallion 215 is provided having an alternative design from medallions previously described. Medallion 215 includes a relatively solid body 217, adapted with opposing openings 300 to accept stem 103. Medallion 215 includes a central body 217 that may be a convex body (upward facing dome). Hexagonal opening 107 may be a raised feature at the apex of the dome on both sides of body 217. In this design, medallion 215 includes a pattern of decorative accurate wing structures 216. Wing structures 216 may be curved upward uniformly toward the outer perimeter, the pattern repeating on the opposite side of the medallion.

Wing structures 216 may be metallic structures that may include steps, ridges, or other defining features. The solid surfaces of medallion body 217 may include proprietary and non-proprietary marks, logos, characters, symbols and so on made by stamping, etching, engraving, plating, or machining. Wing structures 217 are arranged symmetrically about the circumference of body 217 and fixed or otherwise attached thereto.

Regarding medallion bodies in general design, it may be noted that the designs depicted in FIG. 1 and FIG. 2 A-D are symmetric and identical from the perspective of top or bottom views. Therefore, design attributes like spokes, apertures, raised surfaces, grooves, steps, and other features resulting from fabrication and assembly may occupy both top and bottom sides of the disc body. However, the design of the medallion body is not limited to having the same design at both top and bottom of the body. Each body regardless of design includes hexagonal opening 107 adapted to accept stem 103 therethrough to transform the medallion into a functioning whirligig.

Figure 3A:
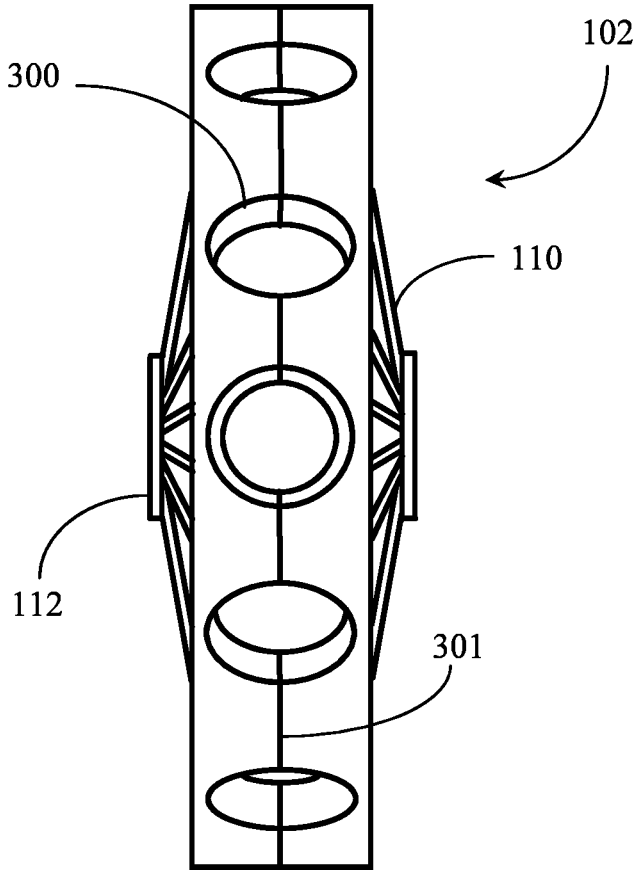
FIG. 3A is a side elevation view of the medallion body of FIG. 1.

FIG. 3A is a side elevation view of medallion body 102 of FIG. 1. Medallion body 102 may comprise two half parts that may be welded together, pressed together using pins, or otherwise fixed together in true alignment to form a medallion. In this embodiment, medallion body 102 includes a raised central hub or ring 111 through which the previously described hex opening 107 is provided to accept the axle portion of stem 103 (not illustrated). Ring 111 is raised above the outer ring of medallion body 102 on both sides of the body.

Spokes 110 extend out from center radially and angularly down to the inside of the outer ring of the body. Spoke features are decorative features and are not necessarily required to practice the present invention. However, in this design they are structural components holding body parts together in the concentric design of body 102. Medallion body 102 includes openings 300 placed at opposite pairs in a pattern of at least one pair but typically multiple opposing pairs of openings arranged at equal spacing or to maintain equal weight distribution about the circumference of body 102. Each opposing pair of openings 300 represents a through opening extending in at least alignment through the center of the medallion body at hexagonal feature 107.

In this embodiment, any of the available pairs of openings 300 may be used to accept stem 103 to hang body 102 vertically. Flange 403 at the stem point 108 of stem 103 is larger in diameter than openings 300 and therefore provides a stop for hanging body 102 as a worn decorative medallion or pendant. Fewer side openings 300 may be provided in medallion body 102 without departing from the spirit and scope of the invention. However, the pattern must remove material equally and must maintain symmetric architecture to maintain the weight balance property of the body when used as a top or whirligig body.

Figure 3B:
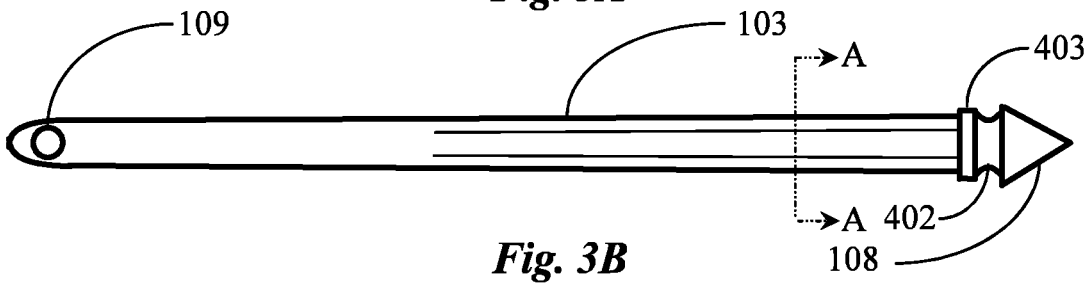
FIG. 3B is a side elevation view of the stem of FIG. 1 according to an embodiment of the invention.

FIG. 3B is a side elevation view of stem 103 according to an embodiment of the invention. Stem 103 may be a solid metallic part. Stem 103 may be manufactured from a metallic stock rod or a composite polymer material that may already have a geometric form having equally spaced facets like a hexagonal rod. The hexagonal form of stem 103 represents the stock form of the stem piece and the taper may take the hex stock form down to the minimum diameter removing the hex form some distance above the stem point. This enables stem 103 to be inserted into the medallion body to be worn or through the central hex opening to function as an axle for the top or whirligig. Stem point 108 doubles as a point to spin the body in the form of a whirligig with flange 403 retaining the body 102 on the stem 103 in position to spin.

Stop flange 403 provides a stop for medallion body 102 to rest against when suspended as a medallion and when used as an axle in the whirligig application. In one embodiment, groove 402 might be used as a string seat groove having a pull string wrapped there around that may be pulled while stem point 108 is stable such as in a small pit or dimple to prevent the point from slipping when the string is pulled to induce spin. In another embodiment, groove 402 is a material relief groove or a decorative groove.

Stem 103 may be tapered slightly from the flange 403 of point 108 back to the rounded top end with through-hole 109. Therefore, the hexagonal form may extend only partially in length from the point back as described above. The hexagonal form prevents the medallion body from slipping when used as a whirligig. Other geometric forms may also be substituted for a hexagonal form of stem 103. Stem 103 is longer in length dimension than the outside diameter of the medallion body for suspension purposes.

Figure 3C:
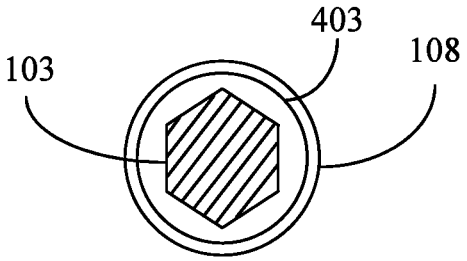
FIG. 3C is an enlarged section view of the stem of FIG. 3B taken along section lines AA.

FIG. 3C is an enlarged section view of stem 103 taken along section lines AA of FIG. 3B. Stem 103 may be fabricated from heavy solid metal rod of hardened steel or another heavy metal that is resistive to ding or denting or pitting. Stem 103 is a solid stem in this example but may in one embodiment be fabricated of heavy wall tubing without departing from the spirit and scope of the invention. Stem point 108 provides the spinning point for the body when in use as a whirligig. The hexagonal form of stem 103 is just smaller in outside diameter than the inside diameter of hexagonal through opening 107, described in FIG. 2A-2D, at the center of all the illustrated bodies. Stop flange 403 is just smaller in diameter than a diameter of stem point 108 taken where it meets groove 402. Stop flange 403 may be the same diameter or larger in diameter than the diameter of stem point 108, referenced above, without departing from the scope of the invention.

Figure 4:
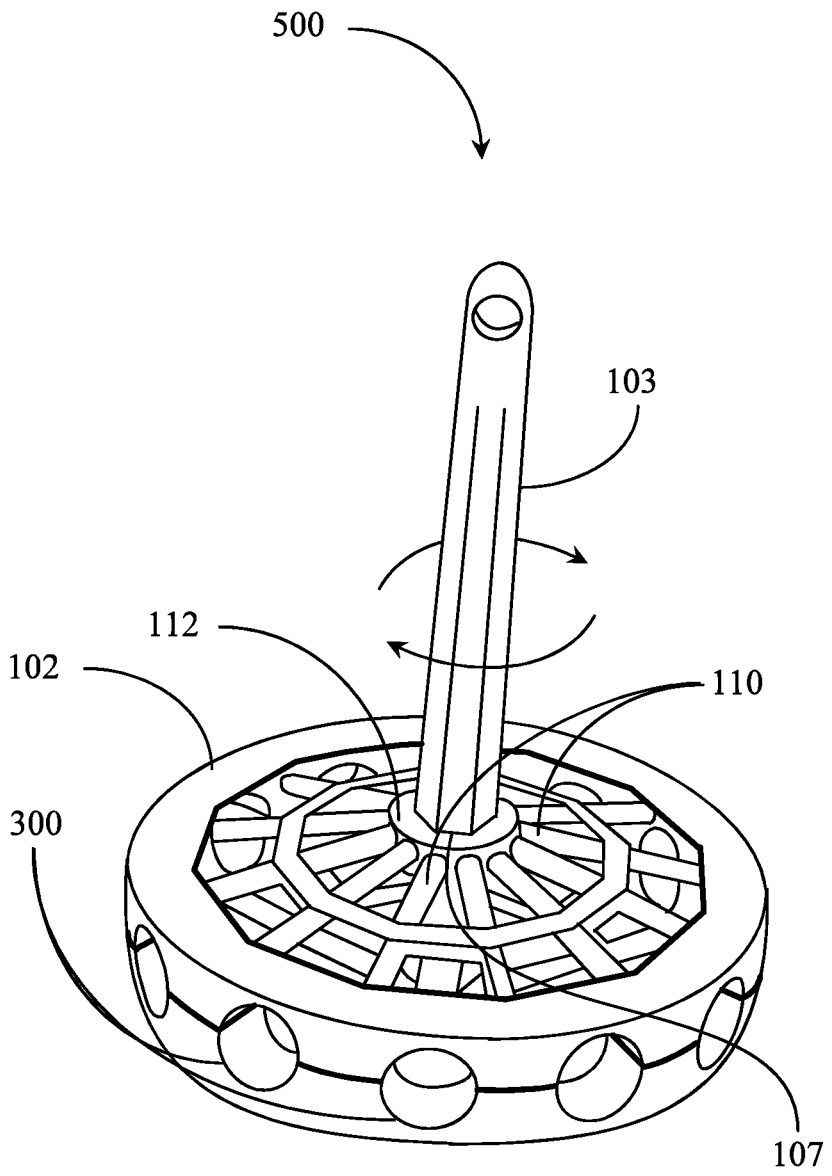
FIG. 4 is a perspective view of a whirligig (top transformation) with the medallion body of FIG. 1 placed over the stem of FIG. 1.

FIG. 4 is a perspective view of a whirligig (top transformation) 500 with medallion body 102 placed over stem 103 of FIG. 1. Medallion body 102 is placed down over stem 103 by a user. Body 102 aligns with the hexagonal form of stem 103. Body 102 may be aligned by hand to enable the hex opening 107 of ring 112 on the medallion body to accept the hex form of stem 103. The larger diameter stop flange 403 stops the medallion body 102 above stem point 108 (not visible) of stem 103.

Whirligig 500 may be spun by the user in either direction. When a user is finished using the medallion as a whirligig, the user may remove (lift) body 102 from stem 103 and insert the top of stem 103 through any of opposing openings 300 to transform the application back into a hanging medallion the user may attach onto a key ring or wear as a pendant from a neck chain or tether loop.

One with skill in the art will recognize that the disc like form of medallion body 102 is limited in design only by requirement of an even, in this case, radial distribution of weight about a center point. Bodies of various physical forms and designs may be substituted for medallion body 102 where those bodies include the hexagonal through opening that matches the hexagonal form of stem 103 and at least one opposing pair of side openings 300 for suspending the medallion body vertically over the stem.

It will also be apparent to the skilled artisan that the transformable medallion of the present invention may be enabled using some or all the described elements without departing from the spirit and scope of the present invention. The invention is limited only by the breadth of the claims below.

The invention claimed is:

1. A medallion transformable into a whirligig assembly comprising:

an ornamental medallion having a symmetric body with the weight of the body distributed equally about the center-point of the body, the body having a perimeter boundary and a height dimension less than the dimension of the perimeter boundary;

a central opening provided through the body, the central opening having a symmetric form aligned perpendicularly to the central plane of weight distribution of the body;

at least one stem opening provided through the side of the body, the at least one stem opening extending orthogonally through the central opening and extending the opening through opposing sides of the body; and an elongated stem having a first end formed as a whirligig point concentric with the longitudinal axis of the stem and a second end formed as an attachment end, the first end including a stop flange concentric with the longitudinal axis of the stem located just above the base of the whirligig point, the diameter of the flange larger than the diameters of the central opening and the at least one stem opening;

wherein the stem is inserted through one of the at least one stem openings leading with the second end of the stem and may be attached to a mechanism to suspend the body vertically on the stem and, wherein the stem may be inserted through the central opening of the body leading with the second end of the stem to enable function as a whirligig.

2. The whirligig assembly of claim 1, wherein the symmetric body is annular.

3. The whirligig assembly of claim 1, wherein the central opening is hexagonal.

4. The whirligig assembly of claim 1, wherein the symmetric body and the stem are fabricated of metal material.

5. The whirligig assembly of claim 1, wherein the symmetrical body is fabricated of polymer with equally distributed weight inserts about the perimeter of the body.

6. The whirligig assembly of claim 1, wherein the elongated stem has a hexagonal form extending from the stop flange above the point to a point along the longitudinal axis toward the second end.

7. The whirligig assembly of claim 1, wherein the elongated stem is tapered conically in diameter from the stop flange to the tip of the second end.

8. The whirligig assembly of claim 1, further including a radial groove on the elongated stem adjacent to the stop flange on the point side of the flange.

9. The ornamental trinket of claim 1 further including:

a pattern of material relief cutouts arranged symmetrically about the whirligig body in accordance with equal distribution of body weight, the cutouts providing sound during operation of the assembly as an assembled whirligig.

10. A method for assembling a functional whirligig from an ornamental medallion, the medallion including a body with a central opening, at least one stem opening extending through the body orthogonally through the central opening extending out at opposing sides of the whirligig body, and an elongated stem having a point and a stop flange at a first end, and an attachment feature connected to a suspension mechanism at a second end including the steps of:

(a) removing the suspended medallion from the suspension mechanism, (b) remove the body from the stem; and (c) insert the stem through the central opening of the body aligning the geometric form of the central opening and stem and sliding the body down to the stop flange on the stem, thereby assembling a whirligig;

(d) placing the whirligig point on a surface plane and orienting the whirligig in a vertical upright position enabling a user to spin the whirligig.

11. The method of claim 10 wherein in step (a), the suspension mechanism is a chain, tether, or a carabiner.

12. The method of claim 10 wherein in step (c), the geometric form is a hexagon.

13. The method of claim 10 wherein in step (a), the whirligig body is fabricated of polymer with equally distributed weight inserts about the perimeter of the body.

14. A method for assembling a wearable medallion from a whirligig, the whirligig including a body with a central opening and at least one stem opening extending through the whirligig body orthogonally through the central opening extending out at opposing sides of the whirligig body, and an elongated stem having a point and a stop flange at a first end, and an attachment feature connected to a suspension mechanism at a second end including steps:

(a) removing the whirligig body from the stem;

(b) inserting the stem from the attachment end through one of the at least one stem openings, sliding the body down to the stop flange suspending the body vertically on the stem; and (c) attaching the stem to the suspension mechanism.

15. The method of claim 14 wherein in step (c), the suspension mechanism is a chain, tether, or a carabiner.

16. The method of claim 14 wherein in step (a), the whirligig body is fabricated of polymer with equally distributed weight inserts about the perimeter of the body.

* * * * *